US009271578B2

(12) United States Patent
Choi et al.

(10) Patent No.: US 9,271,578 B2
(45) Date of Patent: Mar. 1, 2016

(54) MATTRESS AND METHOD OF ADJUSTING PRESSURE OF MATTRESS

(71) Applicant: CERAGEM CELLUPEDIC. CO., LTD, Pyeongtaek-si, Gyeonggi-do (KR)

(72) Inventors: Jin Young Choi, Seoul (KR); Seong Chan Park, Cheongju-si (KR); Young Jun Yu, Anyang-si (KR); Sung Gon Kim, Seongnam-si (KR); Dong Jin Kim, Cheongju-si (KR)

(73) Assignee: CERAGEM CELLUPEDIC. CO., LTD, Pyeongtaek-si (KR)

( * ) Notice: Subject to any disclaimer, the term of this patent is extended or adjusted under 35 U.S.C. 154(b) by 0 days.

(21) Appl. No.: 14/061,612

(22) Filed: Oct. 23, 2013

(65) Prior Publication Data

US 2014/0047645 A1 Feb. 20, 2014

Related U.S. Application Data

(63) Continuation of application No. PCT/KR2012/010452, filed on Dec. 5, 2012.

(30) Foreign Application Priority Data

Dec. 5, 2011 (KR) ..... 10-2011-0129271

(51) Int. Cl.
*A47C 27/08* (2006.01)
*A47C 27/10* (2006.01)

(52) U.S. Cl.
CPC ..... *A47C 27/083* (2013.01); *A47C 27/10* (2013.01)

(58) Field of Classification Search
CPC ..... A61G 7/05776; A61G 7/05769; A61G 2203/34; A61G 7/015; A61G 2203/12; A61G 7/1021; A61G 2203/44; A61G 13/1265; A47C 27/10; A47C 27/082; A47C 27/081; A47C 27/083; A61B 2562/0247; A61B 5/1036
USPC ..... 5/710, 713, 706, 655.3, 654, 644
See application file for complete search history.

(56) References Cited

U.S. PATENT DOCUMENTS 4,838,309 A * 6/1989 Goodwin ..... 137/554
4,852,195 A * 8/1989 Schulman ..... 5/713

(Continued)

FOREIGN PATENT DOCUMENTS

JP 06-341912 A 12/1994
KR 10-2004-0012647 A 2/2004

(Continued)

OTHER PUBLICATIONS

Written Opinion of the International Searching Authority dated Mar. 28, 2013 of PCT/KR2012/010452 which is the parent application and English Translation—8 pages.

(Continued)

*Primary Examiner* — Nicholas Polito
*Assistant Examiner* — Myles Throop
(74) *Attorney, Agent, or Firm* — Knobbe Martens Olson & Bear LLP

(57) ABSTRACT

A mattress and a method of adjusting the pressure of a mattress are provided. The method includes a first process of measuring internal pressure before a user lies on a mattress having at least two zones in which cells having a closed inner space filled with fluid are formed, a second process of measuring an increase in the internal pressure of each cell occurring when the user lies on the mattress, and an average pressure adjusting process of adjusting an amount of the fluid introduced into each cell of the mattress based on a pressure variation caused by a difference between the internal pressure detected from each cell in the first process and the internal pressure detected from each cell in the second process.

15 Claims, 8 Drawing Sheets

(56) References Cited

U.S. PATENT DOCUMENTS

| | | | | | |
|---|---|---|---|---|---|
| 4,982,466 | A * | 1/1991 | Higgins et al. | 5/713 | |
| 5,020,176 | A * | 6/1991 | Dotson | 5/710 | |
| 5,052,067 | A * | 10/1991 | Thomas et al. | 5/713 | |
| 5,062,169 | A * | 11/1991 | Kennedy et al. | 5/713 | |
| 5,170,364 | A * | 12/1992 | Gross | A47C 4/54 | 297/284 |
| 5,235,713 | A * | 8/1993 | Guthrie et al. | 5/710 | |
| 5,267,364 | A * | 12/1993 | Volk | 5/713 | |
| 5,606,754 | A * | 3/1997 | Hand et al. | 5/713 | |
| 5,666,681 | A * | 9/1997 | Meyer et al. | 5/727 | |
| 5,685,036 | A * | 11/1997 | Kopfstein et al. | 5/713 | |
| 5,815,864 | A * | 10/1998 | Sloop | 5/706 | |
| 5,848,450 | A * | 12/1998 | Oexman et al. | 5/713 | |
| 5,873,137 | A * | 2/1999 | Yavets-Chen | A61G 7/05776 | 5/188 |
| 5,983,429 | A * | 11/1999 | Stacy et al. | 5/713 | |
| 6,202,672 | B1 * | 3/2001 | Ellis et al. | 137/223 | |
| 6,212,719 | B1 * | 4/2001 | Thomas et al. | 5/713 | |
| 6,253,401 | B1 * | 7/2001 | Boyd | 5/713 | |
| 6,269,505 | B1 * | 8/2001 | Wilkinson | 5/713 | |
| 6,353,950 | B1 * | 3/2002 | Bartlett et al. | 5/617 | |
| 6,721,980 | B1 * | 4/2004 | Price | A61B 5/0205 | 5/710 |
| 6,789,284 | B2 * | 9/2004 | Kemp | 5/713 | |
| 6,813,790 | B2 * | 11/2004 | Flick et al. | 5/713 | |
| 6,877,178 | B2 * | 4/2005 | Chapman et al. | 5/713 | |
| 7,520,011 | B1 | 4/2009 | Liberkowski | | |
| 8,745,788 | B2 * | 6/2014 | Bhai | A61G 7/015 | 5/600 |
| 8,973,186 | B2 * | 3/2015 | Bhai | A61G 7/015 | 5/600 |
| 9,047,750 | B2 * | 6/2015 | Tamez | A61B 5/1135 | |
| 9,119,566 | B2 * | 9/2015 | Sakai | A61B 5/6892 | |
| 2004/0128772 | A1 * | 7/2004 | Branson et al. | 5/713 | |
| 2004/0139546 | A1 * | 7/2004 | Ferrand et al. | 5/425 | |
| 2007/0199154 | A1 | 8/2007 | Escaross | | |
| 2008/0289108 | A1 * | 11/2008 | Menkedick et al. | 5/610 | |
| 2011/0302720 | A1 * | 12/2011 | Yakam et al. | 5/710 | |
| 2013/0263378 | A1 * | 10/2013 | O'Keefe | A61G 7/002 | 5/713 |
| 2014/0007656 | A1 * | 1/2014 | Mahoney | G01M 3/3218 | 73/49.3 |
| 2014/0283308 | A1 * | 9/2014 | Chen | A61G 7/018 | 5/699 |

FOREIGN PATENT DOCUMENTS

| | | | |
|---|---|---|---|
| KR | 10-2010-0074359 | A | 7/2010 |
| KR | 10-2010-0090784 | A | 8/2010 |
| KR | 10-2011-0031538 | A | 3/2011 |
| WO | 91/13575 | A1 | 9/1991 |
| WO | 97/36521 | A1 | 10/1997 |
| WO | 2011/006093 | A1 | 1/2011 |

OTHER PUBLICATIONS

International Search Report dated Mar. 28, 2013 of PCT/KR2012/010452 which is the parent application and English Translation—6 pages.

Supplementary European Search Report dated Jun. 24, 2015 of corresponding European Patent Application No. 12855267.6—5 pages.

* cited by examiner

MATTRESS AND METHOD OF ADJUSTING PRESSURE OF MATTRESS

BACKGROUND

1. Technical Field

The present disclosure relates generally to a mattress and a method of adjusting pressure of a mattress.

2. Discussion of Related Technology

A sleeping apparatus includes all things associated with sleep such as a mattress, a pocket spring, a foundation unit, a bed frame, a pillow, a mattress pad, and linen. That is, the sleeping apparatus generally includes any types of sleeping products having an influence on the sleep of a human being. Such a sleeping apparatus is suitable for some persons but not others. The sleeping apparatus suitable for many persons is dependent on various factors such as physical attributes (weight, height, physique dimensions, and weight distribution), a preferred sleeping pose, and a sleeping habit.

The factors having a great influence on the sleep of a person are bearing pressure and comfort.

First, the sleeping apparatus maintains the person in a proper pose so as to support the person, and uniformly distributes the weight of the person throughout a wide range again, thereby relieving interface pressure. For example, the mattress provides a bearing pressure based on a resistance force of an internal spring which resists a force applied downward by the weight of the person.

Second, the sleeping apparatus is configured so that a soft material is disposed in a region that comes into contact with the body of the person, thereby offering comfort to the body. The sleeping apparatus may be manufactured in such a manner that, for example, a firm pad and a firmer high-density form are placed on the internal spring so as to provide various levels of firmness or hardness to the mattress. Further, the sleeping apparatus may be manufactured in such a manner that a corrugated form or a low-density form, and a tender fabric material such as wool, silk, or cassimere are placed on the internal spring so as to provide various levels of softness or a more comfortable feeling to the mattress.

Conventionally, in order to allow a user to be satisfied with the aforementioned sleeping apparatus, a method of partly changing the elastic force of the mattress so as to be able to increase the comfort or of using a form for increasing the comfort is used. However, this conventional method has a limit in offering the bearing pressure and the comfort suitable for the user.

SUMMARY

Accordingly, the present disclosure is directed to providing a method and apparatus for adjusting the pressure of a mattress, which is capable of adjusting pressure suitable for a user to increase proper bearing force and comfort.

Further, the present disclosure is directed to providing a method and apparatus for adjusting the pressure of a mattress, in which cells made up of a plurality of air pockets are adjusted so as to have different pressures for respective zones, thereby allowing a user to increase satisfaction.

In addition, the present disclosure is directed to providing a method and apparatus for adjusting the pressure of a mattress, which measures internal pressure before a user lies on the mattress in which closed cells are formed in respective zones and increased internal pressure after the user lies on the mattress, estimate weight of the user based on the measured pressures, and adjust average pressure and partial pressure, thereby allowing the user to increase satisfaction.

An aspect of the invention provides a mattress, which may comprise: a mattress body comprising a plurality of air compartments, which comprises a first air compartment and a second air compartment; a plurality of conduits connected to the plurality of air compartments and comprising a first conduit and a second conduit, the first conduit being in fluid communication with the first air compartment, the second conduit being in fluid communication with the second air compartment; a valve system comprising a plurality of valve ports connected to the plurality of conduits and comprising a first valve port and a second valve port, the first valve port being connected to the first conduit, the second valve port being connected to the second conduit; an air pump connected to the valve system and configured to supply air pressure to the valve system; at least one air pressure sensor configured to detect air pressure within the first and second air compartments; and a controller configured to control the air pump and further configured to control the valve system such that the first valve port is turned open to supply air pressure from the air pump to the first air compartment through the first conduit while the second valve port is closed and further such that the second valve port is turned open to supply air pressure from the air pump to the second air compartment through the second conduit while the first valve port is closed, whereby air pressure within the first air compartment is adjusted differently from the air pressure within the second air compartment.

In the foregoing mattress, the controller may be programmed to run an air pressure adjustment mode, wherein when the air pressure adjustment mode is initiated, the controller is configured to control the air pump, the valve system and the at least one air pressure sensor: to obtain air pressures of the first air compartment and the second air compartment while no load is placed on the mattress; to obtain air pressures of the first air compartment and the second air compartment while a user is on the mattress; to set a first target air pressure for the first air compartment and a second target air pressure for the second air compartment based on the air pressures of the first and second air compartments that were detected when no load was placed on the mattress and further based on the air pressures of the first and second air compartments that were detected when the user was on the mattress; and to individually pump the first and second air compartments to cause the air pressure within the first and second air compartments to reach the first and second targets, respectively.

Still in the foregoing mattress, the first target air pressure may be determined based on a difference between the air pressure of the first air compartment detected when no load was placed on the mattress and the air pressure of the first air compartment detected when the user was on the mattress and further based on a reference value determined using the air pressures of the plurality of air compartments that were detected when the user was on the mattress. The reference value may be indicative of a firmness level. The reference value may be determined using the weight of the user. The reference value may be determined using an average of the differences between the air pressures of the plurality of air compartments when the no load was on the mattress and the air pressures of the plurality of air compartments when the user was on the mattress. The controller may be configured to control the air pump, the valve system and the at least one air pressure sensor such that the plurality of compartments are in fluid communication with each other, and further such that the at least one air pressure sensor obtain an overall air pressure of the plurality of compartments that are in fluid communication with each other when the user was on the mattress, wherein the reference value is determined using the overall air pressure.

Yet in the foregoing mattress, the first air compartment may be located under a first predetermined surface area of the mattress that is mostly supporting the user's butt or shoulder. The first target air pressure may be determined based on a difference between the air pressure of the second air compartment detected when no load was placed on the mattress and the air pressure of the first air compartment detected when the user is on the mattress and further based on a reference value computed using the air pressures of the plurality of air compartments that were detected when the user was on the mattress. The first target air pressure may be computed further based on a volume of the first compartment. The first air compartment may be located under a first predetermined surface area of the mattress that is mostly supporting the user's leg or head, wherein the second air compartment is located under a second predetermined surface area of the mattress that is mostly supporting the user's shoulder or butt. The valve system may comprise a plurality of valves, each of which comprises one of the plurality of valve ports.

Another aspect of the invention provides a method of adjusting air pressure of a mattress, which may comprise: providing the foregoing mattress; obtaining air pressures of the first air compartment and the second air compartment while no load is placed on the mattress; obtaining air pressures of the first air compartment and the second air compartment while a user is on the mattress; setting a first target air pressure for the first air compartment and a second target air pressure for the second air compartment based on the air pressures of the first and second air compartments that were detected when no load was placed on the mattress and further based on the air pressures of the first and second air compartments that were detected when the user was on the mattress; and individually pumping the first and second air compartments to cause the air pressure within the first and second air compartments to reach the first and second targets, respectively.

In the foregoing method, setting may comprise determining the first target air pressure based on a difference between the air pressure of the first air compartment detected when no load was placed on the mattress and the air pressure of the first air compartment detected when the user was on the mattress and further based on a reference value determined using the air pressures of the plurality of air compartments that were detected when the user was on the mattress. Setting may further comprise determining the reference value using an average of the differences between the air pressures of the plurality of air compartments when the no load was on the mattress and the air pressures of the plurality of air compartments when the user was on the mattress. The method may further comprise: operating the valve system such that the plurality of compartments that are in fluid communication with each other; and obtaining an overall air pressure of the plurality of compartments that are in fluid communication with each other when the user is on the mattress, wherein the reference value is determined using the overall air pressure.

Still in the foregoing method, the first air compartment may be located under a first predetermined surface area of the mattress that is mostly supporting the user's butt or shoulder. Setting may comprise determining the first target air pressure based on a difference between the air pressure of the second air compartment detected when no load was placed on the mattress and the air pressure of the first air compartment detected when the user was on the mattress and further based on a reference value computed using the air pressures of the plurality of air compartments that were detected when the user was on the mattress. The first target air pressure may be determined further based on a volume of the first compartment. The first air compartment may be located under a first predetermined surface area of the mattress that is mostly supporting the user's leg or head, wherein the second air compartment may be located under a second predetermined surface area of the mattress that is mostly supporting the user's shoulder or butt.

A further aspect of the present invention provides a method for adjusting the pressure of a mattress which includes a first process of measuring internal pressure before a user lies on the mattress having at least two zones in which cells having a closed inner space filled with fluid are formed, a second process of measuring an increase in the internal pressure of each cell occurring when the user lies on the mattress, and an average pressure adjusting process of adjusting an amount of the fluid introduced into each cell of the mattress based on a pressure variation caused by a difference between the internal pressure measured for each cell in the first process and the internal pressure measured for each cell in the second process.

Here, the average pressure adjusting process may include obtaining an average pressure variation of the pressure variations generated from the cells in the first process and in the second process, and adjusting the internal pressures of the cells having a structure in which a plurality of closed air pockets communicate with narrow connecting passages.

Further, the average pressure variation may be calculated by adding a value of the pressure increased in each cell in a closed state after the user lies on the mattress in the second process, and dividing the added pressure value by a number of the zones in which the cells are formed.

Further, the average pressure variation may be calculated by subtracting a value of the pressure, which is obtained in the first process in which the internal pressure is measured before the user lies with the cells closed, from a value of the pressure measured in the second process in which the internal pressure is measured after the user lies with the cells communicating spatially.

In addition, the method may further include a partial pressure adjusting process of additionally adjusting the pressure for some of the cells after the average pressure adjusting process.

Further, after the average pressure variation is calculated by subtracting a value of the pressure, which is obtained in the first process in which the internal pressure is measured before the user lies with the cells closed, from a value of the pressure measured in the second process in which the internal pressure is measured after the user lies with the cells communicating spatially, classes may be divided according to a category in which a numerical value obtained by subtracting the pressure value before the user lies and the average pressure variation from the value of the internal pressure of the cell supporting the buttocks of the user is included, and the buttock partial pressure characteristic value may be determined by the numerical value of the corresponding class.

The method may further include a feedback pressure adjusting process of additionally adjusting the pressures by request of the user after the partial pressure adjusting process.

Further, the feedback pressure adjusting process may include adjusting en bloc the pressures of all the cells of the mattress.

Further, the feedback pressure adjusting process may include adjusting the cells supporting the shoulders and buttocks of the user of the mattress.

Further, the feedback pressure adjusting process may include detecting a voice signal of the user.

Moreover, the method may further include a bed adjustment completion and bed adjusting value guiding process of additionally adjusting the pressure to complete bed adjustment of the mattress having bearing pressure per zone suitable for the user based on a value of the pressure or to guide bed adjusting values.

Yet another aspect of the present invention provides an apparatus for adjusting the pressure of a mattress, which includes a mattress having at least two cells, each of which forms a closed space filled with fluid, so as to support shoulders and buttocks of the user, a hydraulic pump supplying the fluid into the cells, a valve controlling the fluid supplied to each cell, and a pressure sensor detecting pressure of the fluid filled in each cell. The pressures before and after the user lies on the mattress are detected by the pressure sensor, and the pressure of the fluid supplied to each cell by the hydraulic pump is adjusted according to a difference between the detected pressures.

Here, the hydraulic pump and the cells of the mattress may be connected by connecting pipes, and the valve may be connected to the connecting pipes so as to control a flow. A damper may be disposed between the connecting pipes and the hydraulic pump.

Also, the pressure sensor may be installed in a feed pipe connecting the damper and the hydraulic pump.

Further, the pressure sensor may be installed in each cell of the mattress.

The apparatus may further include a controller that receives a value of the pressure measured by the pressure sensor and controls an operation of the hydraulic pump according to the received pressure value. The controller may control an operation of the valve.

Further, the valve may include a solenoid valve that is opened/closed by initial drive voltage and that is kept opened/closed by sustain voltage lower than the initial drive voltage.

In addition, the apparatus may further include a display unit that causes the pressure of the fluid, which is adjusted for each cell of the mattress so as to be suitable for the user, to be recognized by the user. The display unit may enable the user to select a bed in which the pressure of each cell is adjusted so as to be fitted to physical characteristics of the user.

According to the method and apparatus for adjusting the pressure of a mattress as described above, internal pressure before a user lies on a mattress having at least two cells, each of which has an inner space filled with fluid and internal pressure after the user lies on the mattress are measured, and partial pressure suitable for the user is determined based on a change in the pressure, so that the user's satisfaction can increase.

Further, partial pressure suitable for each body part is obtained so as to be suitable for the user, and the user gets some help to select a bed proper to the user based on the partial pressure. As such, the user's satisfaction can increase.

Further, a feedback pressure adjusting process of additionally adjusting pressure after partial pressure of a mattress which is suitable for the user is adjusted, is performed so that the user's satisfaction can increase.

In addition, adjusted pressure of each zone of a mattress is adjusted according to characteristics of a pillow top placed on the mattress, so that the user's satisfaction can increase.

DETAILED DESCRIPTION OF EMBODIMENTS

Hereinafter, a method and apparatus for adjusting the pressure of a mattress, which are exemplary embodiments of the present invention, will be described in detail with reference to the accompanying drawings.

Figure 1:
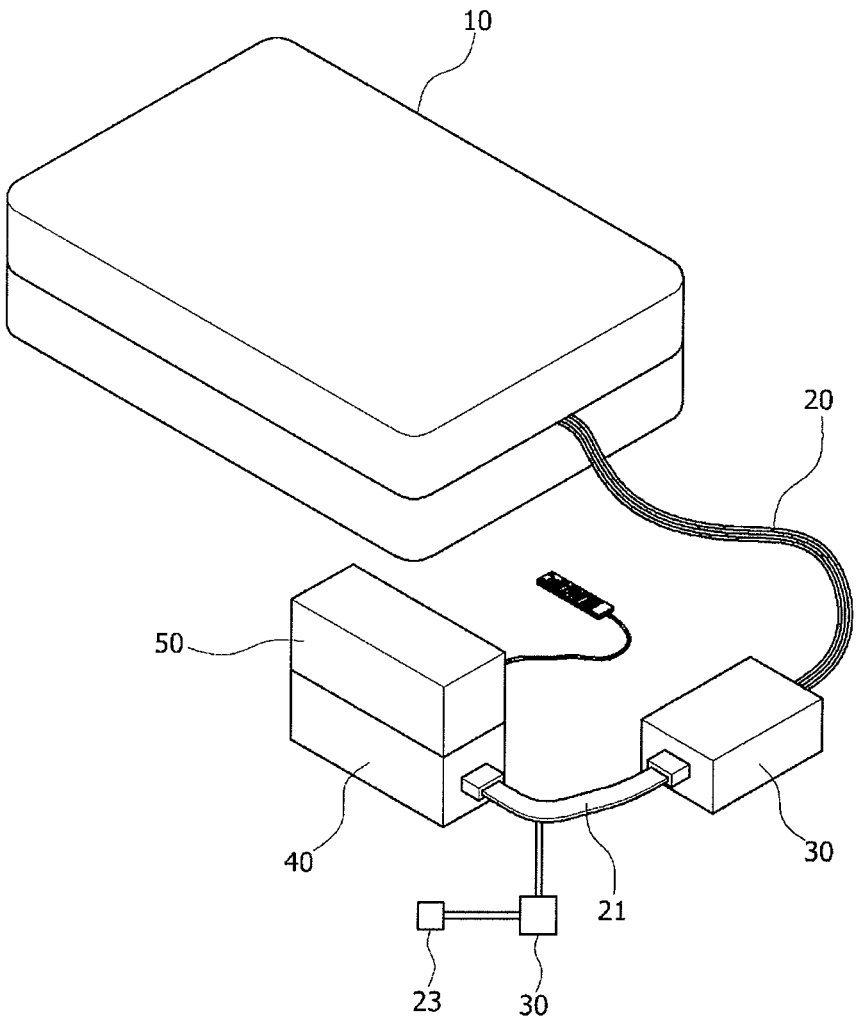
FIG. 1 is a perspective view showing an apparatus for adjusting the pressure of a mattress which is an exemplary embodiment of the present invention.
Figure 2:
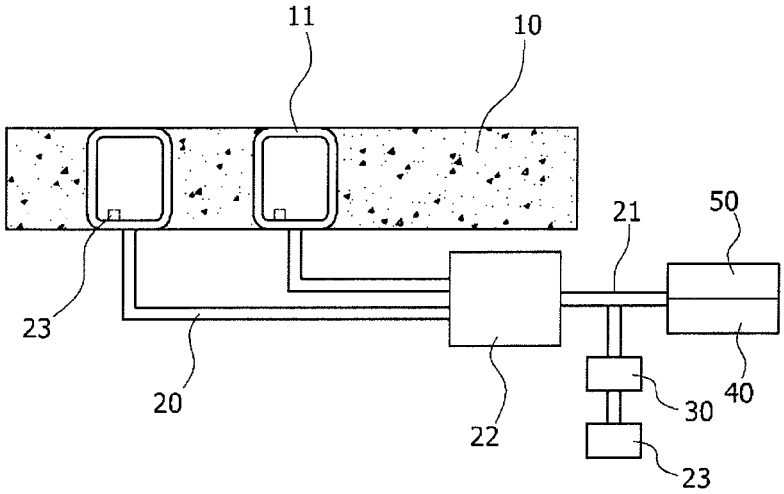
FIG. 2 is a schematic view showing a state of an apparatus for adjusting the pressure of a mattress which is a first embodiment of the present invention.
Figure 3:
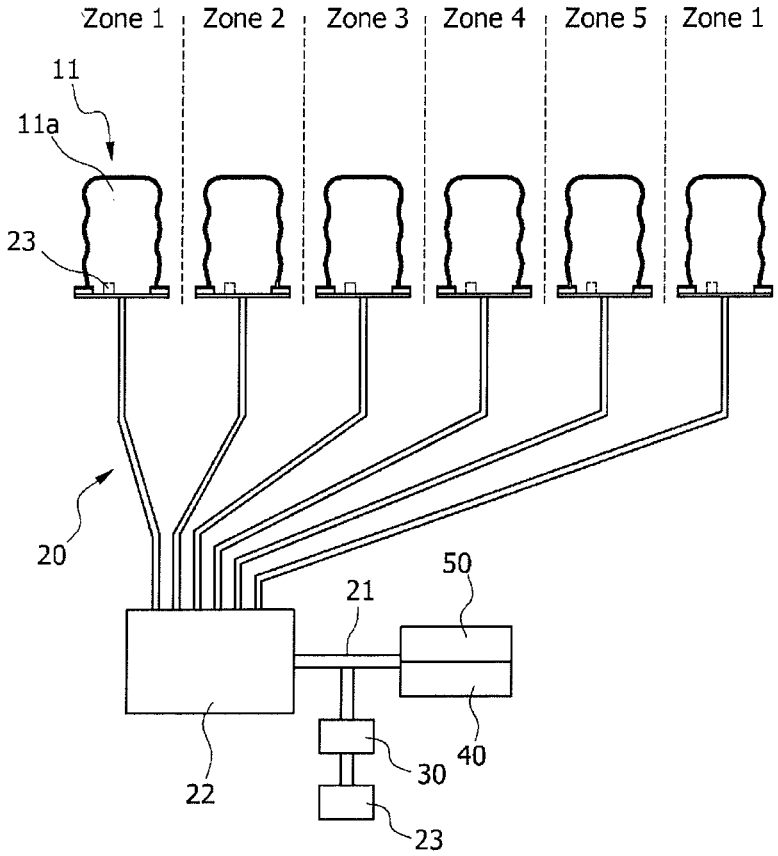
FIG. 3 is a schematic view showing a state of an apparatus for adjusting the pressure of a mattress which is a second embodiment of the present invention.
Figure 4:
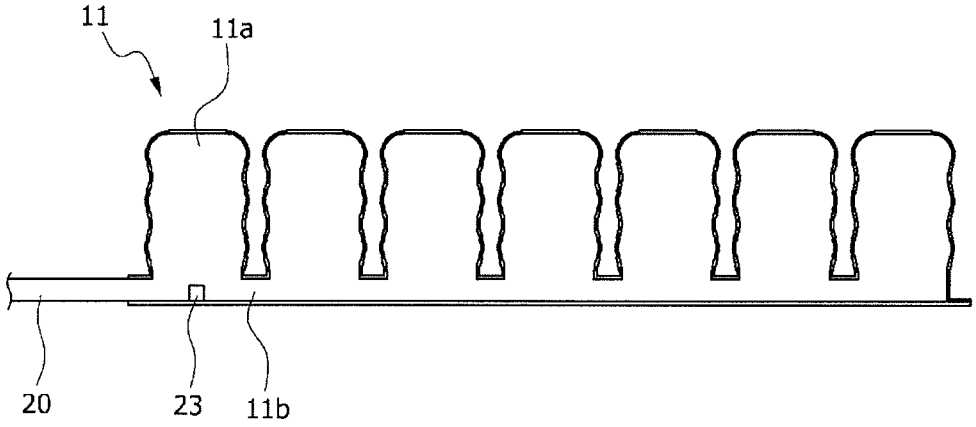
FIG. 4 is a cross-sectional view showing the apparatus for adjusting the pressure of a mattress shown in FIG. 3.
Figure 5:
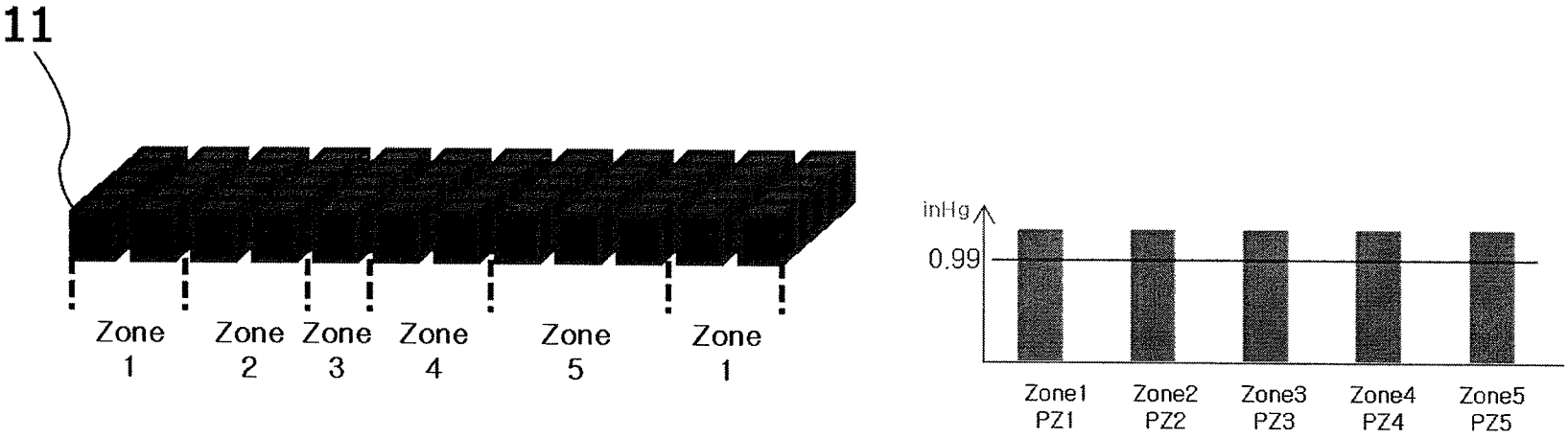
FIG. 5 is a view showing a state before a user lies on a mattress.
Figure 6:
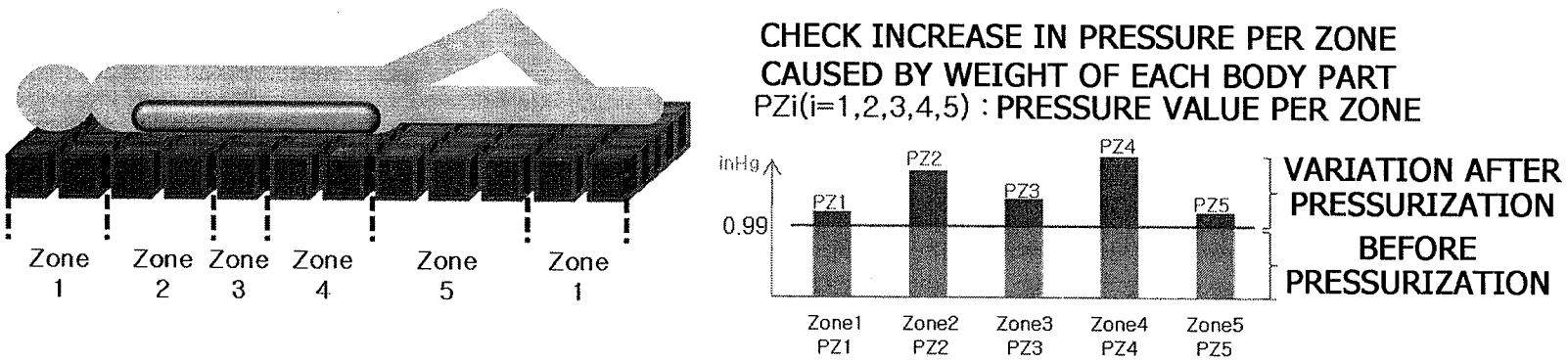
FIG. 6 is a view showing a state when the user lies on the mattress.
Figure 7:
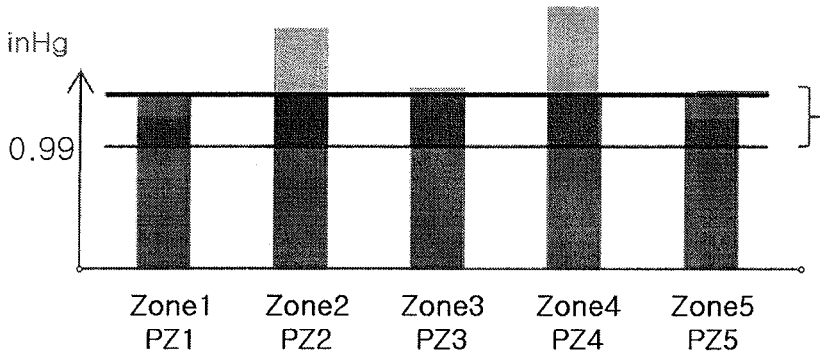
FIG. 7 is a graph showing a change in pressure of the mattress.
Figure 8:
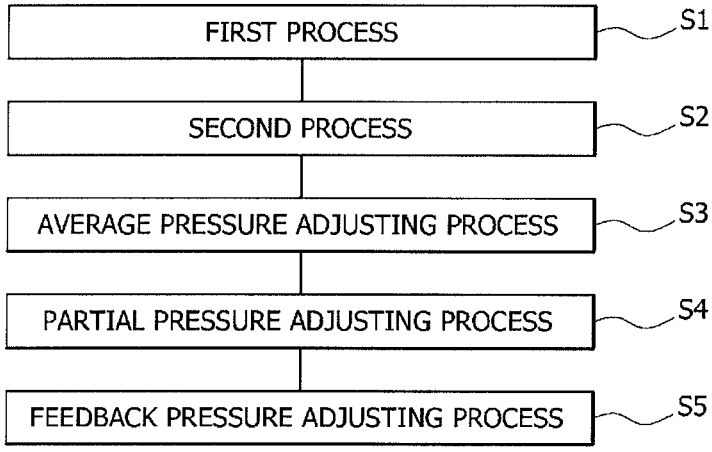
FIG. 8 is a flow chart showing a method for adjusting the pressure of a mattress in process sequence.

FIG. 1 is a perspective view showing an apparatus for adjusting the pressure of a mattress which is an exemplary embodiment of the present invention. FIG. 2 is a schematic view showing a state of an apparatus for adjusting the pressure of a mattress which is a first embodiment of the present invention. FIG. 3 is a schematic view showing a state of an apparatus for adjusting the pressure of a mattress which is a second embodiment of the present invention. FIG. 4 is a cross-sectional view showing the apparatus shown in FIG. 3. FIG. 5 is a view showing a state before a user lies on a mattress. FIG. 6 is a view showing a state when the user lies on the mattress. FIG. 7 is a graph showing a change in pressure of the mattress. FIG. 8 is a flow chart showing a method for adjusting the pressure of a mattress in process sequence. As shown, an apparatus for adjusting the pressure of a mattress which is an exemplary embodiment of the present invention includes a mattress 10 having at least two cells 11, each of which forms a closed space filled with fluid, a hydraulic pump 40 supplying the fluid to the mattress 10, a valve 22 controlling the fluid supplied to each cell 11, a pressure sensor 23 detecting pressure of the fluid filled in each cell 11, a damper 30 in which the fluid supplied by the hydraulic pump 40 is stored under high pressure, a connecting pipe 20 connecting each cell 11 and each valve 22, and a feed pipe 21 connecting the valves 22 and the hydraulic pump 40. The valves 22 are installed so as to be connected to the connecting pipes 20 connected to the cells 11 installed in zones, respectively.

The cells 11 are made up of a plurality of air pockets 11*a* forming separate closed inner spaces and connecting passages 11*b* connecting the air pockets 11*a*.

The pressure sensors 23 are connected to the damper 30. Preferably, the damper 30 is connected between the valves 22 and the hydraulic pump 40, and is connected to the pressure sensors 23. Alternatively, the pressure sensors 23 may be configured so as to be mounted in the respective cells 11 without being connected to the damper 30. Here, each pressure sensor 23 detects pressure of the fluid filled in each cell 11.

Further, the apparatus includes a controller 50 that receives a pressure value measured by each pressure sensor 23 and controls an operation of the hydraulic pump 40 based on the pressure value. Further, the controller 50 controls an operation of each valve 22 to adjust an amount of the fluid supplied to each cell 11.

Each valve 22 may employ one of flow control valves, each of which controls a flow rate. Each valve 22 preferably employs a solenoid valve that can be opened/closed by initial drive voltage and that can be kept opened/closed by sustaining voltage lower than the initial drive voltage.

As shown in FIG. 2, the mattress 10 may include a typical spring mattress or a mattress formed of a cushion material, and have a structure in which the cell 11 is formed in two or more zones thereof. Here, each cell 11 preferably supports one of the shoulders and buttocks of a user.

As shown in FIG. 3, the mattress 10 may be formed in a structure in which a plurality of cells 11 are provided in respective zones (Zone1 to Zone5). The number of zones is not limited to five as shown, but may be at least two according to a taste of the user.

As shown in FIG. 3, the cells 11 are arranged such that Zone1 located at one end of the mattress supports the head of the user, Zone1 located at the other end of the mattress supports the feet of the user, Zone2 supports the shoulders of the user, Zone3 supports the waist of the user, Zone4 supports the buttocks of the user, and Zone5 supports the legs of the user. The number of cells 11 arranged for the zones can be adjusted.

A method for adjusting the pressure of a mattress carried out in the first or second embodiment of the present invention which is configured as described above will be described below.

As shown in FIG. 8, a method for adjusting the pressure of a mattress includes a first process S1, a second process S2, an average pressure adjusting process S3, a partial pressure adjusting process S4, and a feedback pressure adjusting process S5 which are sequentially carried out.

As shown in FIG. 5, the first process S1 is a process of measuring internal pressure in a state in which a user does not lie on the cells 11 filled with fluid. Here, all the valves 22 are kept closed. In a state in which the cells 11 are closed, pressure in each cell 11 is measured. When the pressure sensors 23 are mounted in the respective cells 11, a method of operating the pressure sensors 23 to measure the pressures in the cells 11 in the state in which the valves 22 are closed is used.

When the pressure sensors 23 are only connected to the damper 30, the valves 22 are operated to measure the pressures in the cells 11 so that connecting pipes 20 connected to the cells 11 can be sequentially connected to the pressure sensors 23, and then are closed.

The pressures measured for the respective zones in the first process S1 are the same internal pressures as shown in the graph.

Next, as shown in FIG. 6, the second process S2 is a process of measuring the internal pressure of each cell 11 in a state in which a user lies on the mattress 10. Here, the valves 22 installed on the respective connecting pipes 20 are all kept closed. Further, when the pressure sensors 23 are mounted in the respective cells 11, method of operating the pressure sensors 23 to measure the pressures in the cells 11 in the state in which the valves 22 are closed is used. When one pressure sensor 23 is installed, the valves 22 connected to the respective zones are sequentially opened one by one. When pressure of each zone is transmitted to the pressure sensor 23 via the feed pipe 21 and the damper 30, the pressure is measured. Then, the valve 22 of the opened zone is closed, and then the valve 22 connected to the next zone is opened. In this way, the internal pressures Pz1, Pz2, Pz3, Pz4, and Pz5 of all the zones are measured.

When the internal pressures of the respective cells 11 are all measured in the state in which the user lies, the valves 22 are kept closed.

Next, as shown in FIG. 7, in the average pressure adjusting process S3, a pressure variation ΔP caused by a difference between the internal pressure measured for each cell 11 in the first process S1 and the internal pressure measured for each cell 11 in the second process S2 can be obtained. Two methods of obtaining an average pressure variation ΔPave based on the pressure variation ΔP of each zone are as follows.

In the first method, in a state in which the cells 11 installed in the respective zones are all closed, the user lies on the mattress 10, and the pressures are measured in the zones in which the cells 11 are installed. All the measured pressures are added, and are divided by the number of zones in which the cells 11 are installed. As shown in FIG. 2, if the number of zones is two, the sum of pressures is divided by two. As shown in FIG. 3, if the number of zones is five, the sum of pressures is divided by five. Thereby, the average pressure variation ΔPave is calculated.

In the second method, in a state in which the cells 11 are closed, internal pressures of the cells 11 before the user lies are measured in the first process S1 In a state in which all the valves 22 are opened to cause the cells 11 installed in the respective zones to communicate with one another, internal pressures of the cells 11 after the user lies are measured in the second process S2. The sum of the pressures measured in the first process S1 is subtracted from the sum of the pressures measured in the second process S2. Thereby, the average pressure variation ΔPave is calculated. The second method is preferably used. This results from the structure of the mattress in which the plurality of air pockets 11*a* for the cells 11 are interconnected by the connecting passages 11*b*. Each air pocket 11*a* has a repulsive force against pressure applied by weight of a user according to its own elastic force or material characteristics. Further, in the plurality of air pockets 11*a* connected by the narrow connecting passages 11*b*, there is a possibility of a minute pressure difference occurring between the air pocket that comes into contact with the user and the air pocket that does not come into contact with the user. In consideration of the repulsive force difference and the pressure difference among the air pockets 11*a*, the overall pressure variations are preferably measured in the state in which all the cells 11 communicate with one another. Further, it can be found from several tests that it is preferable to calculate the average pressure variation ΔPave using the second method in order to calculate an actual weight of the user.

The calculated average pressure variation ΔPave can be obtained from Equation 1 below.

$$W = A + B^{*}\Delta Pave + C^{*}\mathrm{Cos}(D^{*}\Delta Pave - E) \qquad \text{(Equation 1)}$$

This equation is to derive a solution using a program of Cornell University in the United States in which a genetic algorithm is applied to find an optimization function of data. In Equation 1, A has a value ranging from 1 to 3, B has a value ranging from 300 to 600, C has a value ranging from 1 to 4, D has a value ranging from 400 to 600, and E has a value ranging from 1.00 to 4.00, and preferably A=2, B=500, C=2, D=500, and E=2.

When the weight W of the user is calculated, a firmness level FL is obtained from the weight W. The firmness level FL is a numerical value obtained from the weight of the user, and allows the user to know a pressure value corresponding to his/her own weight.

The firmness level FL can be obtained from Equation 2 below.

$$FL=F*W+10.0 \quad \text{(Equation 2)}$$

Here, F has a value ranging from 0.1 to 1.0, and preferably 0.5. Further, when the weight is less than 40 kg, the firmness level FL is limited to 30. When the weight is more than 120 kg, the firmness level FL is limited to 70. That is, the weight that can be converted through Equation 2 ranges from 40 Kg to 120 kg.

As such, the average pressure adjusting process is completed.

Next, the partial pressure adjusting process S4 begins.

Adjusted pressure of the cell 11 supporting the shoulders of the user is obtained by additionally adding a shoulder partial pressure characteristic value ΔPz2l to the value of the firmness level FL. The adjusted pressure of the cell 11 supporting the buttocks of the user is obtained by adding a buttock partial pressure characteristic value ΔPz4 to the value of the firmness level FL.

Here, classes are divided according to a category in which a numerical value obtained by subtracting both the pressure value before the user lies and the average pressure variation ΔPave from the value of the internal pressure Pz2 of the cell 11 supporting the shoulders of the user is included, and the shoulder partial pressure characteristic value ΔPz2 is determined by the numerical value of the corresponding class. Likewise, classes are divided according to a category in which a numerical value obtained by subtracting both the pressure value before the user lies and the average pressure variation ΔPave from the value of the internal pressure Pz4 of the cell 11 supporting the buttocks of the user is included, and the buttock partial pressure characteristic value ΔPz4 is determined by the numerical value of the corresponding class.

Here, a reference value is obtained by multiplying the numerical value, which is obtained by subtracting both the pressure value before the user lies and the average pressure variation ΔPave from the value of the internal pressure Pz of the cell 11 supporting the shoulders or the buttocks, by 50. When the reference value is included in a range of 0 to 1.5, the class is expressed as "a." Further, the classes are divided by adding 3 to the reference value. That is, when the reference value is included in a range of 1.5 to 4.5, the class is expressed as "b." When the reference value is included in a range of 4.5 to 7.5, the class is expressed as "c." When the reference value is included in a range of 7.5 to 10.5, the class is expressed as "d." When the reference value is included in a range of 10.5 to 13.5, the class is expressed as "e."

The firmness level FL, the shoulder partial pressure characteristic value ΔPz2, and the buttock partial pressure characteristic value ΔPz4, which are obtained in this process, are sequentially expressed and converted into a code.

For example, this code may be expressed as "47bc," where "47" indicates the value of the firmness level FL, "b" indicates the shoulder partial pressure characteristic value ΔPz2, and "c" indicates the buttock partial pressure characteristic value ΔPz4.

As shown in FIG. 3, when the zones supporting the head, the waist, the legs, and the feet are added to the zones supporting the shoulders and the buttocks, each zone is adjusted in the following method. The zone supporting the feet is typically set to the same value as the zone supporting the head.

First, a value of adjusted pressure for the waist uses the value of the firmness level FL as it is.

Next, adjusted pressure for the head or the feet is calculated using Equation 3 below.

Adjusted Pressure for Head or Feet $$=FL-(\Delta Pz2+\Delta Pz4)*(V1/(V1+V5)) \quad \text{(Equation 3)}$$

Next, adjusted pressure for the legs is calculated using Equation 4 below.

Adjusted Pressure for Legs $$=FL-(\Delta Pz2+\Delta Pz4)*(V5/(V1+V5)) \quad \text{(Equation 4)}$$

Here, FL is the value of the firmness level, ΔPz2 is the shoulder partial pressure characteristic value, ΔPz4 is the buttock partial pressure characteristic value, V1 is the internal volume of the cell supporting the head or the feet, and V5 is the internal volume of the cell supporting the legs.

After the partial pressure adjusting process S4 is completed as described above, the pressure may be additionally adjusted. That is, when a pillow top is placed on the mattress 10, a numerical value M may be added or subtracted according to characteristics of the placed pillow top. In other words, as a thickness of the pillow top increases, the adjusted pressures for the waist, the head or the feet, and the legs which are set in the partial pressure adjusting process S4 are preferably reduced.

The feedback pressure adjusting process S5 can adjust the pressure in the two methods below.

In the first method, the overall pressures of the cells 11 of the zones are adjusted en bloc in the state in which the user lies on the mattress 10. That is, if the user wants a slightly softer feeling, the overall pressure of the cells 11 is reduced up to the moment the user feels satisfaction. If the user wants a slightly firmer feeling, the overall pressure of the cells 11 is gradually increased up to the moment the user feels satisfaction.

In the second method, the pressures of the cells 11 installed in the zones supporting the shoulders and the buttocks of the user are adjusted separately or together in the state in which the user lies on the mattress 10. That is, if the user wants a slightly softer feeling, the pressures of the cells 11 are gradually reduced up to the moment the user feels satisfaction. If the user wants a slightly firmer feeling, the pressures of the cells 11 are gradually increased up to the moment the user feels satisfaction.

The feedback pressure adjusting process S5 is preferably performed to recognize a voice signal of the user. That is, the pressure is adjusted in response to the voice signal of the user who says "firm" or "soft" in the state in which the user lies on the mattress 10.

Figure 9:
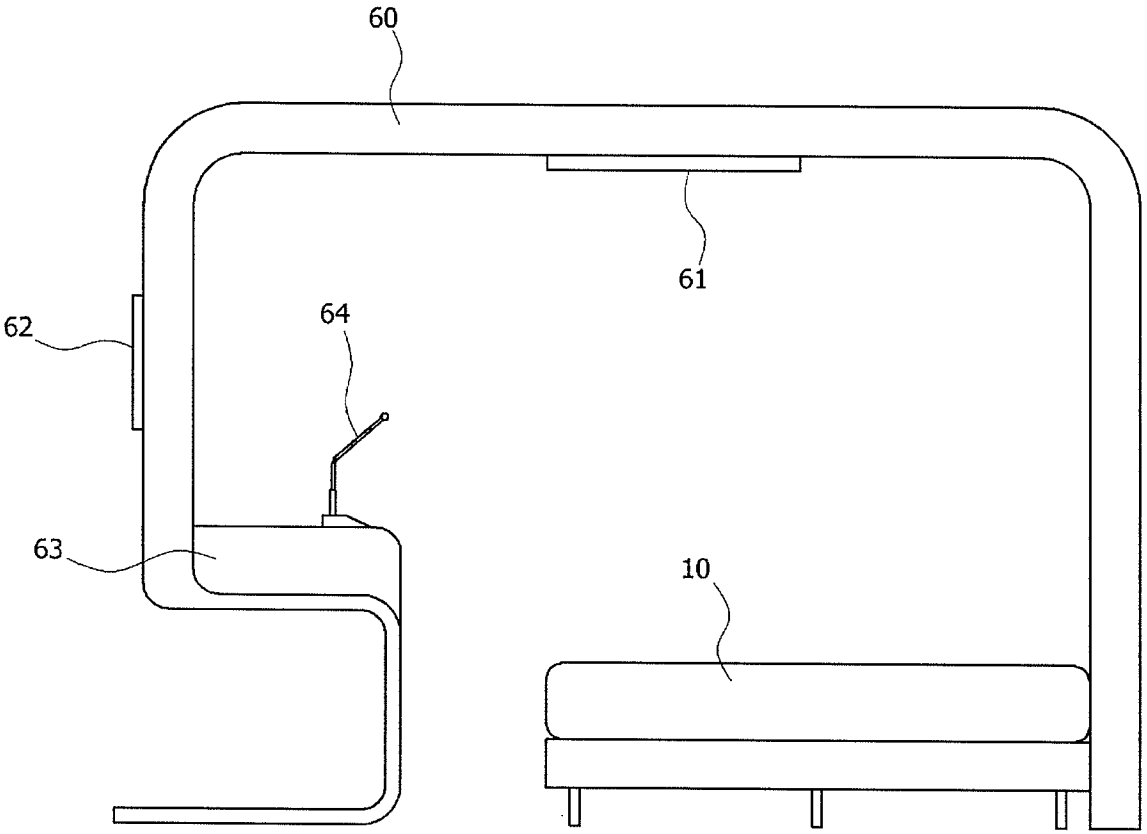
FIG. 9 is a view showing a state of an apparatus for adjusting the pressure of a mattress which is a third embodiment of the present invention.
Figure 10:
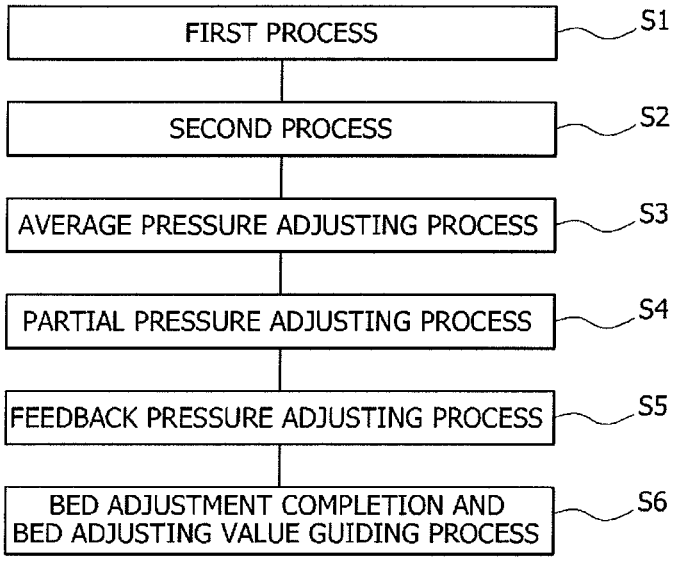
FIG. 10 is a flow chart showing a method for adjusting the pressure of a mattress used for the apparatus shown in FIG. 9 in process sequence.

FIG. 9 is a view showing a state of an apparatus for adjusting the pressure of a mattress which is a third embodiment of the present invention. FIG. 10 is a flow chart showing a method for adjusting the pressure of a mattress used for the apparatus shown in FIG. 9 in process sequence. An apparatus for adjusting the pressure of a mattress which is a third embodiment of the present invention includes a main body 60 in which a mattress 10 is installed, a display unit 61 installed on a ceiling of the main body 60 so as to enable a user to look at a screen in a state in which the user lies on the mattress 10, an input unit 62 installed at one side of the main body 60 so as to enable the user to input his/her own characteristics (height, age, weight, sex, etc.), a control unit 63 provided at one inner side of the main body 60, and a microphone 64 recognizing a voice signal of the user. The display unit 61 may be installed on an inner or outer sidewall of the main body 60 in addition to the ceiling of the main body 60. The display unit 61 installed on the inner or outer sidewall may function as a touch pad that is an input means for inputting the physical characteristics of the user in advance.

In addition, a hydraulic pump 40, valves 22, pressure sensors 23, a damper 30, connecting pipes 20, and cells 11 of respective zones constituting the mattress have the same configuration as in the first and second embodiment of the present invention.

The apparatus for adjusting the pressure of a mattress as configured in this way is an apparatus that can provide a mattress suitable for a user. To this end, the aforementioned processes, i.e. the first process S1, the second process S2, the average pressure adjusting process S3, the partial pressure adjusting process S4, and the feedback pressure adjusting process S5 are performed, and then a bed adjustment completion and bed adjusting value guiding process S6 of completing bed adjustment of the mattress 10 having the bearing pressure per zone suitable for the user, or guiding bed adjusting values is additionally performed.

In the bed adjustment completion and bed adjusting value guiding process S6, the partially adjusted pressures of the head, the shoulders, the waist, the buttocks, the legs, and the feet, which are acquired in the feedback pressure adjusting process S5, are displayed by the display unit 61. This can help the user recognize the pressures to select a bed suitable for him/her.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. A method of adjusting air pressure of a mattress, the method comprising:

providing a mattress comprising:

a mattress body comprising a plurality of air compartments, which comprises a first air compartment and a second air compartment, at least one air pressure sensor configured to detect air pressure within the first and second air compartments, and an air pump configured to supply air pressure to the plurality of air compartments;

obtaining an unloaded air pressure for each of the plurality of air compartments,using the at least one sensor, when no load is placed on the mattress, the first air compartment having a first unloaded air pressure. the second air compartment having a second unloaded air pressure;

obtaining a loaded air pressure for each of the plurality of air compartments, using the at least one sensor, when a user is on the mattress,, the first air compartment having a first loaded air pressure, the second air compartment having a second loaded air pressure;

obtaining an average air pressure difference between the unloaded air pressures and the loaded air pressures of the plurality of air compartments;

determining a first characteristic value for the first air compartment based on the first loaded air pressure, the first unloaded air pressure, and the average air pressure difference such that the first characteristic value represents a differential between the average air pressure difference and a first air pressure difference, wherein the first air pressure difference is a difference between the first loaded air3 pressure and the first unloaded air pressure;

setting a first target air pressure or a first air pressure adjustment for the first air compartment based on the first characteristic value;

determining a second characteristic value for the second air compartment based on the second loaded air pressure, the second unloaded air pressure, and the average air pressure difference such that the second characteristic value represents a differential between the average air pressure difference and a second air pressure difference, wherein the second air pressure difference is a difference between the second loaded air pressure and the second unloaded air pressure;

setting a second target air pressure or a second air pressure adjustment for the second air compartment based on the second characteristic value;

adjusting air pressure, using the pump, of the first air compartment based on the first target air pressure or the first air pressure adjustment; and adjusting, air pressure using the pump, of the second air compartment based on the second target air pressure or the second air pressure adjustment.

2. The method of claim 1, further comprising computing a firmness value representing an overall firmness level of the mattress body based on the average air pressure difference, wherein the first target air pressure is set based on the firmness value and the first characteristic value, wherein the second target air pressure is set based on the firmness value and the second characteristic value.

3. The method of claim 2, wherein the mattress comprises:

a plurality of conduits connected to the plurality of air compartments and comprising a first conduit and a second conduit, the first conduit being in fluid communication with the first air compartment, the second conduit being in fluid communication with the second air compartment, and a valve system comprising a plurality of valve ports connected to the plurality of conduits and comprising a first valve port and a second valve port, the first valve port being connected to the first conduit, the second valve port being connected to the second conduit, wherein the method further comprises:

operating the valve system such that the plurality of compartments that are in fluid communication with each other; and obtaining an overall air pressure of the plurality of compartments that are in fluid communication with each other when the user is on the mattress, wherein the firmness value is determined using the overall air pressure.

4. The method of claim 1, wherein the first air compartment is located under a first predetermined surface area of the mattress that is designated for supporting the user's butt or shoulder.

5. The method of claim 1, wherein the first target air pressure is determined further based on a volume of the first compartment.

6. The method of claim 1, wherein the first air compartment is located under a first predetermined surface area of the mattress that is designated for supporting the user's leg or head, wherein the second air compartment is located under a second predetermined surface area of the mattress that is designated for supporting the user's shoulder or butt.

7. A mattress comprising:

a mattress body comprising a plurality of air compartments, which comprises a first air compartment and a second air compartment, at least one air pressure sensor configured to detect air pressure within the first and second air compartments, and an air pump configured to supply air pressure to the plurality of air compartments;

a controller programmed to run an air pressure adjustment mode for the mattress, wherein when the air pressure adjustment mode is initiated, the controller is configured to control the air pump and the at least one air pressure sensor:

to obtain unloaded air pressure for each of the plurality of air compartments, the first air compartment having a first unloaded pressure, the second air compartment having a second unloaded pressure;

to obtain loaded air pressure for each of the plurality of air compartments, the first air compartment having a first loaded air pressure and the second air compartment having a second loaded pressure;

to obtain an average air pressure difference between the unloaded air pressures and the loaded air pressures of the plurality of air compartments;

to determine a first characteristic value for the first air compartment based on the first loaded air pressure, the first unloaded air pressure, and the average air pressure difference, such that the first characteristic value represents a differential between the average air pressure difference and a first air pressure difference wherein the first air pressure difference is a difference between the first loaded air pressure and the first unloaded air pressure;

to set a first target air pressure or a first air pressure adjustment for the first air compartment based on the first characteristic value;

to determine a second characteristic value for the second air compartment based on the second loaded air pressure, the second unloaded air pressure, and the average air pressure difference, such that the second characteristic value represents a differential between the average air pressure difference and a second air pressure difference wherein the second pressure difference is a difference between the second loaded air pressure and the second unloaded air pressure;

to set a second target air pressure or a second air pressure adjustment for the second air compartment based on the second characteristic value;

to adjust air pressure of the first air compartment based on the first target air pressure or the first air pressure adjustment; and to adjust air pressure of the second air compartment based on the second target air pressure or the second air pressure adjustment.

8. The mattress of claim 7, further comprising:

a plurality of conduits connected to the plurality of air compartments and comprising a first conduit and a second conduit, the first conduit being in fluid communication with the first air compartment, the second conduit being in fluid communication with the second air compartment;

a valve system comprising a plurality of valve ports connected to the plurality of conduits and comprising a first valve port and a second valve port, the first valve port being connected to the first conduit, the second valve port being connected to the second conduit; and the controller configured to control the air pump and further configured to control the valve system such that the first valve port is turned open to supply air pressure from the air pump to the first air compartment through the first conduit while the second valve port is closed and further such that the second valve port is turned open to supply air pressure from the air pump to the second air compartment through the second conduit while the first valve port is closed, whereby air pressure within the first air compartment is adjusted differently from the air pressure within the second air compartment.

9. The mattress of claim 8, wherein the controller is configured to control the air pump, the valve system and the at least one air pressure sensor such that the plurality of compartments are in fluid communication with each other, and further such that the at least one air pressure sensor obtains an overall air pressure of the plurality of compartments that are in fluid communication with each other when the user was on the mattress, wherein a firmness value is determined using the overall air pressure.

10. The mattress of claim 9, wherein the firmness value is determined using the weight of the user.

11. The mattress of claim 7, wherein the controller is configured to compute a firmness value representing an overall firmness level of the mattress body based on the average air pressure difference, wherein the first target air pressure is set based on the firmness value and the first characteristic value, wherein the second target air pressure is set based on the firmness, value and the second characteristic value.

12. The mattress of claim 7, wherein the first air compartment is located under a first predetermined surface area of the mattress that is designated for supporting the user's butt or shoulder.

13. The mattress of Claim 7, wherein the first target air pressure is determined further based on a volume of the first compartment.

14. The mattress of claim 7, wherein the first air compartment is located under a first predetermined surface area of the mattress that is designated for supporting the user's leg or head, wherein the second air compartment is located under a second predetermined surface area of the mattress that is designated for supporting the user's shoulder or butt.

15. The mattress of Claim 7, wherein the valve system comprises a plurality of valves, each of which comprises one of the pluralfity of valve ports.

* * * * *